US007270119B2

(12) United States Patent
Mitsutani

(10) Patent No.: US 7,270,119 B2
(45) Date of Patent: Sep. 18, 2007

(54) AIR/FUEL RATIO CONTROL DEVICE FOR INTERNAL COMBUSTION ENGINE

(75) Inventor: Noritake Mitsutani, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 52 days.

(21) Appl. No.: 10/554,025

(22) PCT Filed: Apr. 22, 2004

(86) PCT No.: PCT/JP2004/005827

§ 371 (c)(1),
(2), (4) Date: Nov. 16, 2005

(87) PCT Pub. No.: WO2004/094800

PCT Pub. Date: Nov. 4, 2004

(65) Prior Publication Data

US 2006/0185655 A1 Aug. 24, 2006

(30) Foreign Application Priority Data

Apr. 22, 2003 (JP) ..... 2003-117468

(51) Int. Cl.
*F02D 41/04* (2006.01)

(52) U.S. Cl. ..... 123/674; 701/103; 701/109

(58) Field of Classification Search ..... 123/674; 701/103, 109

See application file for complete search history.

(56) References Cited

U.S. PATENT DOCUMENTS

| | | | | |
|---|---|---|---|---|
| 4,461,261 | A | 7/1984 | Isomura et al. | |
| 5,775,311 | A | 7/1998 | Kato et al. | |
| 5,884,613 | A * | 3/1999 | Kitamura et al. | 123/696 |
| 6,019,093 | A * | 2/2000 | Kitagawa | 123/674 |
| 6,233,922 | B1 * | 5/2001 | Maloney | 60/276 |
| 6,698,186 | B2 * | 3/2004 | Ueno et al. | 60/277 |
| 6,898,508 | B2 * | 5/2005 | Nakano et al. | 701/103 |
| 7,069,910 | B2 * | 7/2006 | Surnilla et al. | 123/481 |
| 7,162,359 | B2 * | 1/2007 | Yasui | 701/109 |
| 2002/0104310 | A1 | 8/2002 | Ikemoto et al. | |

FOREIGN PATENT DOCUMENTS

| | | |
|---|---|---|
| DE | 198 47 447 A1 | 4/2000 |
| JP | 09-280038 A | 10/1997 |
| JP | 2001-349235 A | 12/2001 |
| JP | 2002-30964 A | 1/2002 |
| JP | 2002-106374 A | 4/2002 |
| JP | A 2002-106374 | 4/2002 |
| JP | 2002-227689 A | 8/2002 |

* cited by examiner

*Primary Examiner*—Erick Solis
(74) *Attorney, Agent, or Firm*—Oliff & Berridge, PLC

(57) ABSTRACT

An air-fuel ratio control apparatus for an internal combustion engine, implementing integral correction of the air-fuel ratio by an integral term edfii obtained by multiplying an integrated difference between a target air fuel ratio and the actual air-fuel ratio by an integral gain, wherein the upper and lower limit values of the integral term are set based on the actual intake air amount and the actual air-fuel ratio. This limits the range of the integral term edfii to prevent it from being set at an excessively high or low level removed from the realities of the intake air amount and the air-fuel ratio, and thereby to prevent erroneous air-fuel ratio correction by the integral term.

11 Claims, 7 Drawing Sheets

AIR/FUEL RATIO CONTROL DEVICE FOR INTERNAL COMBUSTION ENGINE

FIELD OF THE INVENTION

The present invention relates to an air-fuel ratio control apparatus for an internal combustion engine, implementing integral correction of air-fuel ratio by an integral term obtained by multiplying an integrated difference between a target and actual air-fuel ratios by an integral gain.

BACKGROUND OF THE INVENTION

As is well known, some internal combustion engines for vehicles or the like clean up exhaust gas using a three-way catalyst that simultaneously enhances oxidation of unburned components (HC and CO) and reduction of nitrogen oxides (NOx). In order to maintain the purification performance of such a three-way catalyst, it is necessary to combust fuel at an air-fuel ratio that is close to the stoichiometric air-fuel ratio. Therefore, an internal combustion engine equipped with a three-way catalyst performs feedback control such that the air-fuel ratio seeks the stoichiometric air-fuel ratio, while detecting an air-fuel ratio obtained based on oxygen concentration of exhaust gas.

Recently, a three-way catalyst provided with oxygen storage capacity has been commercialized. Such a three-way catalyst stores excessive oxygen when the air-fuel ratio is leaner than the stoichiometric air-fuel ratio and the oxygen concentration in exhaust gas is high, and releases the stored oxygen to compensate for shortage of oxygen when the air-fuel ratio is richer than the stoichiometric air-fuel ratio and the oxygen concentration is low. This suitably maintains exhaust gas purification capacity for the catalyst even when the air-fuel ratio temporarily deviates from the stoichiometric air-fuel ratio. However, because of limited oxygen storage capacity of the catalyst, it is necessary to keep the quantity of oxygen stored by the catalyst in a certain range (e.g., about half of its maximum capacity) to ensure that the catalyst can store or release oxygen on a steady basis.

Therefore, control apparatuses that perform air-fuel ratio feedback by PI control or PID control have been proposed for internal combustion engines, as disclosed by, e.g., Japanese Laid-Open Patent Publication No. 9-280038. Such a control apparatus controls air-fuel ratio by an integral action on a difference detected between a target and actual air-fuel ratios. A PI control system, for example, corrects an air-fuel ratio based on a correction amount obtained using the following formula (1):

$$\text{Air-fuel ratio correction amount}=(\text{Air-fuel ratio difference})\times(\text{Proportional gain})+(\text{Integrated air-fuel ratio difference})\times(\text{Integral gain}) \quad (1)$$

In the formula (1), the first term of the right-hand side [(Air-fuel ratio difference)×(Proportional gain)] is a proportional term, based on which deviation of air-fuel ratio from the stoichiometric air-fuel ratio is compensated. The second term [(Integrated air-fuel ratio difference)×(Integral gain)] is an integral term, based on which steady state deviation of the air-fuel ratio is compensated. More specifically, the integral term corrects air-fuel ratio in such a way as to equalize an integrated quantity of oxygen newly stored by a three-way catalyst with an integrated quantity of oxygen released from the catalyst. Therefore, integral correction of air-fuel ratio stably maintains the quantity of oxygen stored by a three-way catalyst.

It should be noted, however, that an integral term for integral correction of air-fuel ratio is determined based on the history of air-fuel ratios irrespective of the actual intake air amount or air-fuel ratio, which may lead to erroneous air-fuel ratio correction, as described below.

When an internal combustion engine whose air-fuel ratio tends to greatly deviate from the stoichiometric air-fuel ratio is operating at a high intake air amount, this may cause a relatively large absolute value of the integral term. When the engine is decelerated in this state, and the intake air amount is significantly reduced, a high absolute value of the integral term recorded so far at a high load is directly applied immediately after the deceleration, possibly leading to excessive correction of the air-fuel ratio.

Also, when the internal combustion engine is operating at a lower load and lean air-fuel ratio after the engine has been running at a richer air-fuel ratio than the stoichiometric air-fuel ratio for an extended period, the air-fuel ratio will be corrected to be excessively lean immediately since a correction using the integral term makes the air-fuel ratio even leaner. This may lead to misfire.

The erroneous correction of the air-fuel ratio by an integral term can be prevented to some extent by setting the integral gain so that the absolute value of the integral term is relatively small. Setting the integral gain at a small value, however, may deteriorate air-fuel ratio feedback convergence, possibly leading to problems, e.g., deteriorated exhaust emissions.

SUMMARY OF THE INVENTION

It is an objective of the present invention to provide an air-fuel ratio control apparatus for an internal combustion engine, capable of adequately preventing erroneous air-fuel ratio correction by an integral term even if integral correction is adopted for the air-fuel ratio.

In order to achieve the above objective, the present invention provides an air-fuel ratio control apparatus for an internal combustion engine, implementing integral correction of the air-fuel ratio by an integral term obtained by multiplying an integrated difference between a target and actual air-fuel ratios by an integral gain, wherein the upper and lower limits of the integral term are set based on an actual intake air amount and air-fuel ratio.

In the present invention, the integral term is limited within a range between the upper and lower limits, which are set based on an actual intake air amount and air-fuel ratio. Therefore, the integral term is prevented from being set at an excessively high or low level which may lead to erroneous air-fuel ratio correction far removed from the realities of the intake air amount and air-fuel ratio.

For example, the upper and lower limits may be set in such a way as to reduce the interval between them, or reduce the absolute value of each limit, as the actual intake air amount decreases. This prevents excessive correction at a low intake air amount while adequately keeping convergence of the air-fuel ratio feedback control at a high intake air amount, which tends to increase deviation of the air-fuel ratio from its target.

Moreover, the upper and lower limits may be set in such a way to limit the air-fuel ratio correction by the integral term to the lean side as the actual air-fuel ratio is becoming leaner. This prevents the air-fuel ratio from becoming excessively lean as a result of correction by the integral term.

Limiting the integral term range by setting its upper and lower limits may lead to insufficient correction of the air-fuel ratio and deteriorated convergence of the air-fuel ratio to a target ratio, when the actual air-fuel ratio greatly deviates from the target. In such a case, convergence of feedback control of the air-fuel ratio to a target ratio can be ensured by setting the upper and lower limits in such a way as to allow larger correction of the air-fuel ratio by the integral term to the lean side as an actual air-fuel ratio is continuously leaner than a target ratio, or to allow greater correction of the air-fuel ratio by the integral term to the rich side as an actual air-fuel ratio is continuously richer than a target ratio.

Many internal combustion engines provided with a feedback control system for the air-fuel ratio depend on learning control in which a steady state deviation between actual and target air-fuel ratios, obtained based on the history of the differences, is stored as an air-fuel ratio learning value. Integral correction by an integral term may not simply converge to an actual air-fuel ratio at a target ratio, when applied to a learning control system, possibly leading to retarded learning or deteriorated learning accuracy.

It is preferable in such a case to set the upper and lower limits until a steady state deviation is determined for learning control of the air-fuel ratio in such a way as to have a smaller interval between the upper and lower limits, or smaller absolute value of each limit than that after it is determined. Setting the upper and lower limits in this way can reduce the extent of integral correction of the air-fuel ratio until the learning of the air-fuel ratio learning value has been completed, and keep speed and accuracy of the learning air-fuel ratio at an adequate level while implementing integral correction.

DETAILED DESCRIPTION OF THE PREFERRED EMBODIMENTS

An air-fuel ratio control apparatus according to one preferred embodiment of the present invention for an internal combustion engine will now be described by referring to the attached drawings.

Figure 1:
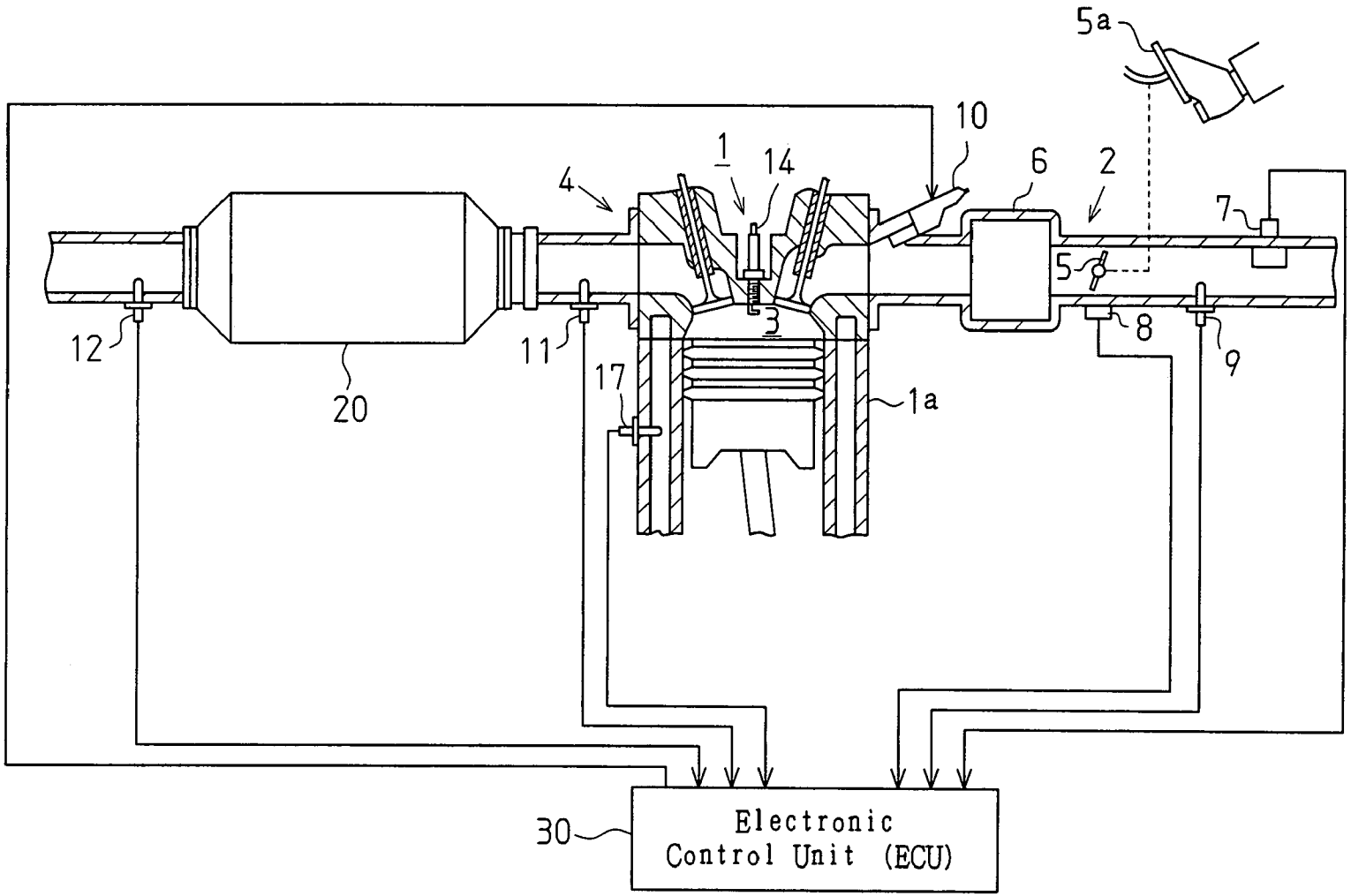
FIG. 1 diagrammatic view showing one embodiment of an air-fuel ratio control apparatus of the present invention.

FIG. 1 outlines the structure for an internal combustion engine 1 for an automobile, equipped with an air-fuel ratio control apparatus according to the present embodiment of the present invention. The internal combustion engine 1 is equipped with an intake air passage 2, combustion chambers 3 and an exhaust gas passage 4.

The intake air passage 2 of the internal combustion engine 1 is equipped with a surge tank 6 and a throttle valve 5 positioned upstream of the tank 6. Opening of the throttle valve 5 varies depending on the extent that the gas pedal is pressed downward to control the rate of intake air flowing into each combustion chamber 3 via the intake air passage 2 (i.e., intake air amount ega).

The intake air passage 2 is equipped with an intake air amount sensor 7, a throttle position sensor 8, and an intake air temperature sensor 9. The intake air amount sensor 7, positioned upstream of the throttle valve 5, senses intake air amount ega. The throttle position sensor 8 is equipped with an opening sensor which senses opening of the throttle valve 5 and an idle switch which is on when the throttle valve 5 is fully shut. The intake air temperature sensor 9 senses temperature of the intake air (THA) flowing into the internal combustion engine 1.

The intake air passage 2 is also equipped with fuel injection valves 10, which injects fuel supplied under pressure from the fuel tank into the intake air passage 2. The injected fuel is supplied into the combustion chambers 3, after being mixed with air in the intake air passage 2.

The exhaust gas passage 4 in the internal combustion engine 1 is equipped with a three-way catalyst 20, an air-fuel ratio sensor 11, and an oxygen sensor 12. The air-fuel ratio sensor 11 is positioned in the exhaust gas passage 4 upstream of the three-way catalyst 20 and the oxygen sensor 12 is positioned in the exhaust gas passage 4 downstream of the three-way catalyst 20.

The three-way catalyst 20 exhibits its purification functions for removing carbon monoxide (CO), hydrocarbons (HCs) and nitrogen oxides (NOx) in exhaust gas most efficiently when the oxygen concentration of exhaust gas around the catalyst corresponds to an air-fuel ratio near the stoichiometric air-fuel ratio. The three-way catalyst 20 in this embodiment has an oxygen-storage capacity, adsorbing excessive oxygen when its concentration of the ambient exhaust gas is excessively high, and releasing oxygen when its concentration is excessively low to compensate for the shortage. Thus, the three-way catalyst 20 autonomously adjusts the ambient oxygen concentration to keep its exhaust gas purification functions high.

Figure 2:
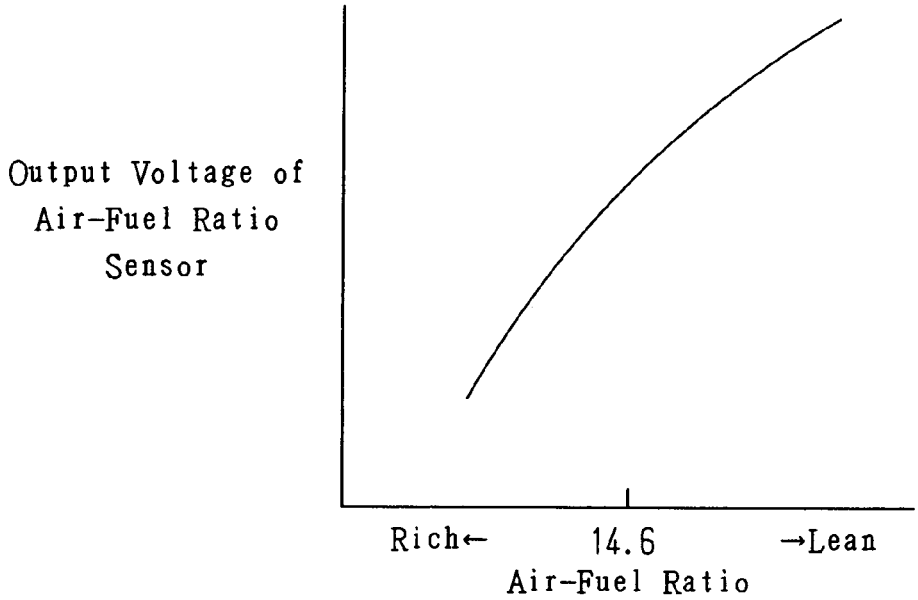
FIG. 2 is a characteristic curve showing the relationship between the air-fuel ratio and an output voltage from an air-fuel ratio sensor.
Figure 3:
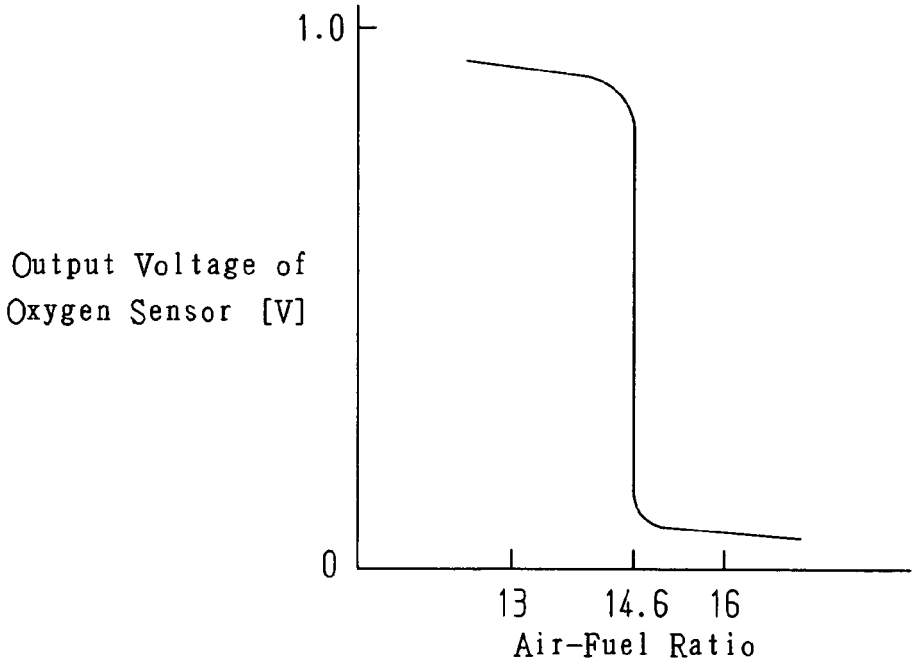
FIG. 3 is a characteristic curve showing the relationship between the air-fuel ratio and an output voltage from an oxygen sensor.

The air-fuel ratio sensor 11 produces voltage which is almost in proportion to the oxygen concentration of the exhaust gas, as shown in FIG. 2. Therefore, the actual air-fuel ratio is detected from the output voltage of the air-fuel ratio sensor 11. On the other hand, the output voltage of the oxygen sensor 12 greatly depends on whether the air-fuel ratio is leaner or richer than the stoichiometric air-fuel ratio. Thus, the output voltage of the oxygen sensor 12 indicates whether the actual air-fuel ratio is richer or leaner than the stoichiometric air-fuel ratio.

Each of the combustion chambers 3 in the cylinders of the internal combustion engine 1 is equipped with an ignition plug 14, to which an ignition voltage is applied at a necessary timing by an igniter and ignition coil.

The internal combustion engine 1 is cooled by coolant circulating through the cylinder block 1*a*. The coolant temperature sensor 17 provided at the cylinder block 1*a* senses the temperature of the coolant.

Each of the sensors, i.e., throttle position sensor 8, intake air amount sensor 7, intake air temperature sensor 9, coolant temperature sensor 17, air-fuel ratio sensor 11, and oxygen sensor 12, is connected to an electronic control unit 30 (hereinafter referred to as ECU 30). The ECU 30 is composed of a CPU, ROM, RAM, and a microcomputer with a built-in backup RAM, among others. To the ECU 30, the fuel injection valve 10 and igniter and the like are connected, in addition to the sensors.

The ECU 30 is responsible for controlling various components of the internal combustion engine 1, e.g., fuel injection valve and igniter. The air-fuel ratio control system in this embodiment is described in detail.

For the three-way catalyst 20 in this embodiment having an oxygen-storage capacity to effectively exhibit its exhaust gas purification functions, it is necessary to keep a sufficient oxygen storage capacity while adsorbing a sufficient quantity of oxygen. The three-way catalyst 20 can store or release oxygen as required when it has sufficient capacity (e.g., about half of the maximum capacity stored in the three-way catalyst 20), while adsorbing a sufficient quantity of oxygen, to always maintain sufficient exhaust gas purification functions.

The ECU 30 in this embodiment implements feedback control for the air-fuel ratio in such a way as to keep the quantity of oxygen stored by the three-way catalyst 20 at a constant level, in order to allow the catalyst 20 to stably exhibit the exhaust gas purification functions. More specifically, the ECU 30 senses the difference between a target (i.e., theoretical) and actual air-fuel ratios from output voltage of the air-fuel ratio sensor 11, and implements feedback control of the air-fuel ratio by proportional-plus-integral action (PI action) based on the difference (i.e., PI control).

The PI control of the air-fuel ratio can be implemented by correcting the air-fuel ratio using an air-fuel ratio correction amount composed of a proportional term and an integral term, the former being an air-fuel ratio difference multiplied by a proportional gain and the latter being an integrated air-fuel ratio difference multiplied by an integral gain (refer to Formula (1)). It should be noted, however, that the integral term for the PI control is determined based on the history of air-fuel ratios irrespective of the actual intake air amount or the actual air-fuel ratio. This may lead to erroneous air-fuel ratio correction depending on the conditions, as described earlier.

The ECU 30 in this embodiment, therefore, implements the PI control of air-fuel ratio by setting the upper and lower limits of the integral term based on the actual intake air amount ega and the actual air-fuel ratio eabyf to limit the value of the integral term within a range between these limits. This allows the ECU 30 to prevent the integral term from being set at an excessively high or low level which may lead to erroneous air-fuel ratio correction far removed from the realities of the intake air amount ega and the air-fuel ratio eabyf.

Figure 4:
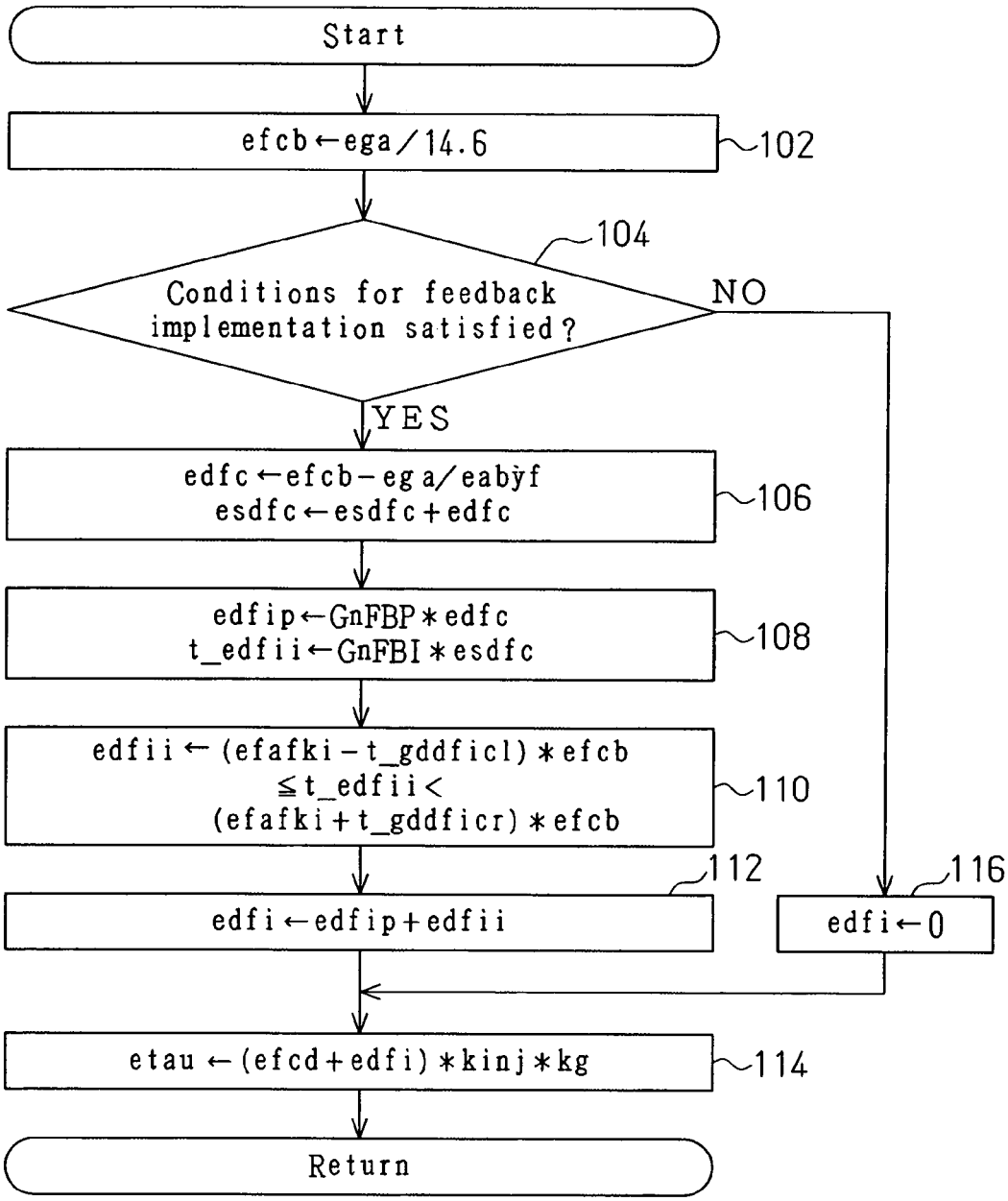
FIG. 4 is a flowchart illustrating a procedure for feedback control of the air-fuel ratio according to the same embodiment.

Next, the feedback control for the air-fuel ratio in this embodiment is described in detail by referring to the flowchart shown in FIG. 4. The ECU 30 implements the routine shown in FIG. 4 by constant-angle interruption at every predetermined crank angle.

On starting the interruption processing, the ECU 30 first divides the intake air amount ega sensed by the intake air amount sensor 7 by the stoichiometric air-fuel ratio tabyf (14.6) to obtain a basic injection amount efcb (Step 102).

Next, the ECU 30 determines whether or not the requirements for feedback implementation are satisfied (Step 104). For example, the ECU 30 determines that the requirements for feedback implementation are satisfied when all of the following conditions are met:

(1) The coolant temperature is at a predetermined level or higher.

(2) The internal combustion engine is not being started.

(3) Fuel supply is not increasing, e.g., for starting the engine.

(4) Output of the air-fuel ratio sensor 11 has been inverted at least once.

(5) Fuel cutoff is not being executed.

The ECU 30, when determining that the feedback implementation requirements are not satisfied because at least one of the above five conditions is not met (Step 104: NO), implements Step 116, and then implements Step 114 after setting a feedback correction amount (edfi) at 0.

On the other hand, the ECU 30, when determining that the feedback implementation requirements are satisfied because all of the above five conditions are met (Step 104: YES), implements Step 106, and then Step 114 after setting a feedback correction amount (edfii) by the processing in Steps 106 to 112.

In Step 106, the ECU 30 calculates the fuel quantity actually consumed for combustion (ega/eabyf), based on the actual intake air amount ega and the actual air-fuel ratio eabyf, sensed by the intake air amount and air-fuel ratio sensors 7 and 12, respectively. The ECU 30 calculates a fuel difference edfc by subtracting the basic injection amount efcb obtained in Step 102 by the fuel quantity actually consumed for combustion. The ECU 30 also calculates a new integrated fuel difference esdfc in Step 106 by adding the fuel difference edfc to the previous integrated fuel difference esdfc.

In subsequent Step 108, the ECU 30 calculates a proportional term edfip by multiplying the fuel difference edfc by a proportional gain GnFBP. The ECU 30 also calculates a provisional integral term t_edfii by multiplying the integrated fuel difference esdfc by an integral gain GnFBI.

In subsequent Step 110, the ECU 30 calculates an integral term edfii after limiting the value of the provisional integral term t_edfii obtained in Step 108 with a lower limit correction rate (efafki−t_gddficl) and upper limit correction rate (efafki+t_gddficr). More specifically, the ECU 30 takes an integral term edfii as the lower limit correction rate when the provisional integral term t_edfii is below the lower limit correction rate, and the integral term edfii as the upper limit correction rate when the provisional integral term t_edfii is above the upper limit correction rate. Moreover, the ECU 30 takes the provisional integral term t_edfii directly as the integral term edfii when the provisional integral term t_edfii is above the lower limit correction rate and, at the same time, below the upper limit correction rate. The upper and lower limit correction rates are set beforehand in the correction amount limiting control, described later.

In subsequent Step 112, the ECU 30 adds the integral term edfii obtained in Step 110 to the proportional term edfip obtained in Step 108, the sum being set as the feedback correction amount edfi.

The ECU 30 sets the feedback correction amount edfi in Step 112 or 116, and adds the feedback correction amount edfi to the basic injection amount efcb in Step 114 to calculate a final injection amount. Then, the ECU 30 multiplies the final injection amount by a coefficient kinj and air-fuel ratio learning value kg to calculate an injector 10 energization time etau for fuel injection. The coefficient kinj is the reciprocal of the fuel injection rate (amount of fuel injected per unit time) at the injector 10, and obtained based on fuel pressure or the like. The air-fuel ratio learning value kg is obtained in the air-fuel ratio learning control step, described later.

Figure 5:
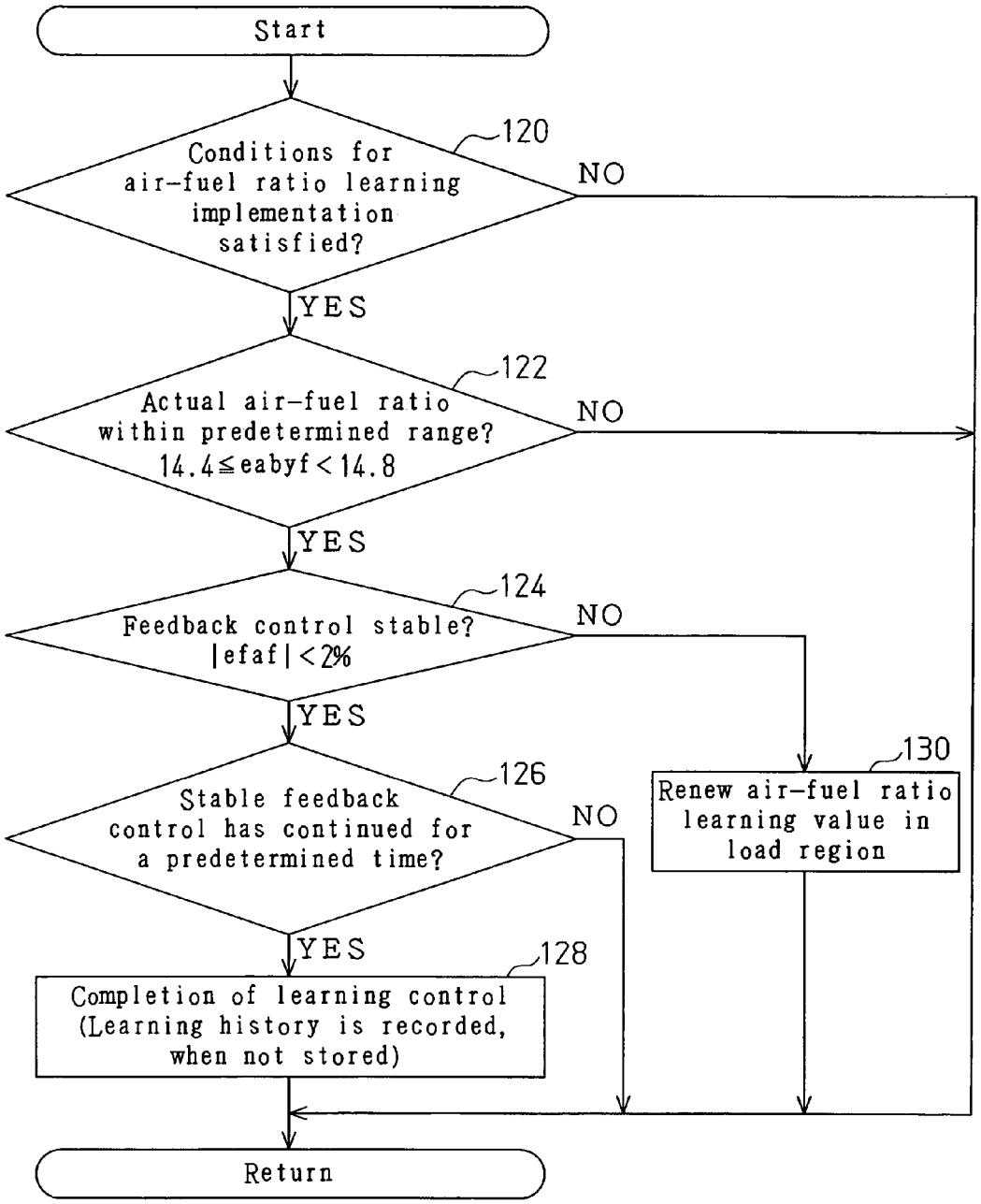
FIG. 5 is a flowchart illustrating a procedure for air-fuel ratio learning control according to the same embodiment.

The air-fuel ratio learning control for calculating the air-fuel ratio learning value kg is described by referring to the flowchart shown in FIG. 5. The ECU 30 implements the routine shown in FIG. 5 by constant-angle interruption at every predetermined crank angle. In this processing step, the ECU 30 calculates the air-fuel ratio learning value kg individually for each of region into which the engine load is divided.

On starting the processing, the ECU 30 first determines whether or not requirements for air-fuel ratio learning implementation are satisfied (Step 120). For example, these requirements are satisfied when all of the following conditions are met: (1) coolant temperature is at a predetermined level or higher, (2) purging is not being implemented, (3) a load region is within a predetermined range, and (4) fuel cutoff is not being performed. The ECU 30, when determining that the air-fuel ratio learning implementation requirements are satisfied (YES), implements Step 122. When determining that the requirements are not satisfied (NO), the ECU 30 ends the current processing.

In Step 122, the ECU 30 determines whether or not the actual air-fuel ratio eabyf is sufficiently close to a target air-fuel ratio, i.e., stoichiometric air-fuel ratio (e.g., $14.4 \leqq eabyf < 14.8$). The ECU 30, when determining that the actual air-fuel ratio eabyf converges at a level close to the stoichiometric air-fuel ratio (YES), implements Step 124. Otherwise (NO), the ECU 30 ends the current processing.

In Step 124, the ECU 30 determines whether or not the feedback control is stable, e.g., based on the feedback correction ratio efaf, i.e., the ratio of the feedback correction amount (edfi) relative to the basic injection amount efcb. The ECU 30 determines that the air-fuel feedback control is stable, when the absolute value of the feedback correction ratio efaf is below 2%, and it is unstable when the absolute value of the feedback correction ratio efaf is 2% or more. The ECU 30, when determining that the air-fuel feedback control is stable (YES), implements Step 126. Otherwise (NO), the ECU 30 implements Step 130.

When the processing step proceeds to Step 130, the ECU 30 renews the air-fuel ratio learning value kg in the load region in such a way as to reduce the absolute value of the feedback correction ratio efaf, and then ends the current processing.

When the processing step proceeds to Step 126, on the other hand, the ECU 30 determines whether or not the air-fuel ratio feedback control has been stably working continuously for more than a predetermined time. The ECU 30, when determining that the air-fuel feedback control has been stable continuously for the predetermined time (YES), implements Step 128. Otherwise (NO), the ECU 30 ends the current processing.

In Step 128, the ECU 30 determines that the air-fuel ratio learning in the load region is temporarily completed and ends the current processing after storing the air-fuel ratio learning value kg and the history of completion of the learning in a backup RAM. The history is kept until data stored in the backup RAM are erased, e.g., by replacing the battery with a new one.

Figure 6:
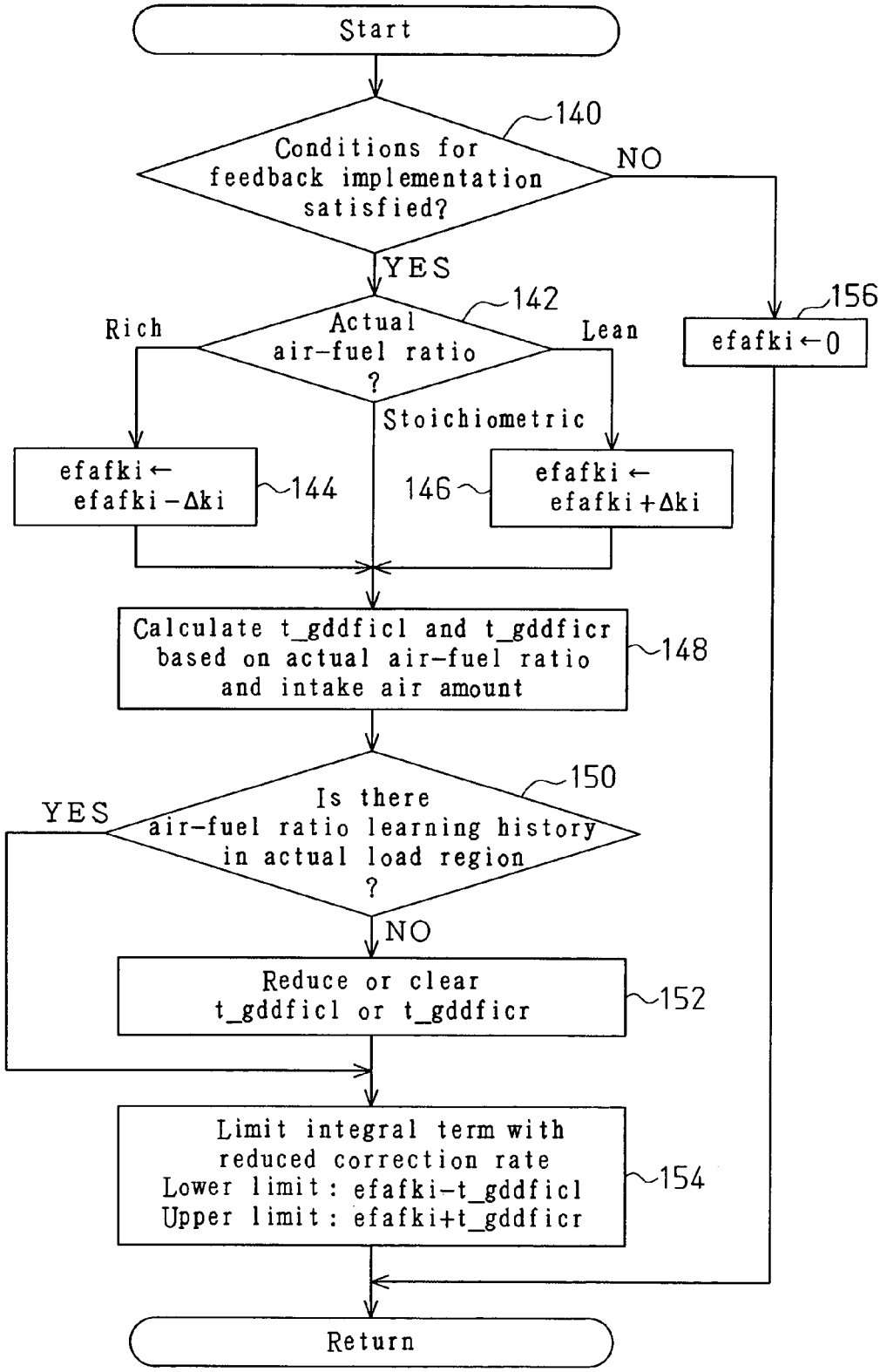
FIG. 6 is a flowchart illustrating a procedure for correction rate limiting control according to the same embodiment.

The correction amount limiting control is described by referring to the flowchart shown in FIG. 6. This step calculates the lower and upper limit correction rates, which limit the value of an integral term edfii for the air-fuel ratio feedback control. The ECU 30 implements the routine shown in FIG. 5 by constant-angle interruption at every predetermined crank angle.

When this processing starts, the ECU 30 first determines whether or not requirements for feedback implementation are satisfied (Step 140). This determination is implemented in a manner similar to that for the air-fuel ratio feedback control in Step 104, illustrated in FIG. 4. The ECU 30, when determining that the implementation requirements are satisfied (YES), implements Step 142. Otherwise (NO), it implements Step 156, where it sets a basic correction rate efafki at 0 before temporarily stopping the processing routine.

In Step 142, on the other hand, the ECU 30 determines whether an actual air-fuel ratio eabyf is at the stoichiometric level or richer or leaner than this level. The ECU 30, when determining that the air-fuel ratio eabyf is richer than the stoichiometric level, implements Step 144 to subtract from the basic correction rate efafki a correction rate difference Δki, and then implements Step 148. When determining that the air-fuel ratio eabyf is leaner than the stoichiometric level, on the other hand, the ECU 30 implements Step 146 to add a correction rate difference Δki to the basic correction rate efafki, and then implements Step 148. When determining that the air-fuel feedback control is at the stoichiometric level, the ECU 30 implements Step 148 directly with the basic correction rate efafki as it is.

The value for the correction rate difference Δki is set according to the magnitude of the intake air amount ega. More specifically, it is set in such a way as to increase as the intake air amount ega increases. Therefore, the larger the intake air amount ega is, the greater the basic correction rate is changed.

The basic correction rate efafki is a fuel injection correction rate serving as a standard, based on which of the upper and lower limits of an integral term edfii are set. The basic correction rate efafki is determined based on the history of air-fuel ratios, as described earlier. More specifically, the basic correction rate efafki is gradually varied to reduce the fuel injection amount when the actual air-fuel ratio eabyf is continuously richer than the stoichiometric air-fuel ratio, and to increase the fuel injection amount when the ratio eabyf is continuously leaner than the stoichiometric air-fuel ratio, in order to correct the fuel injection amount.

Figure 7:
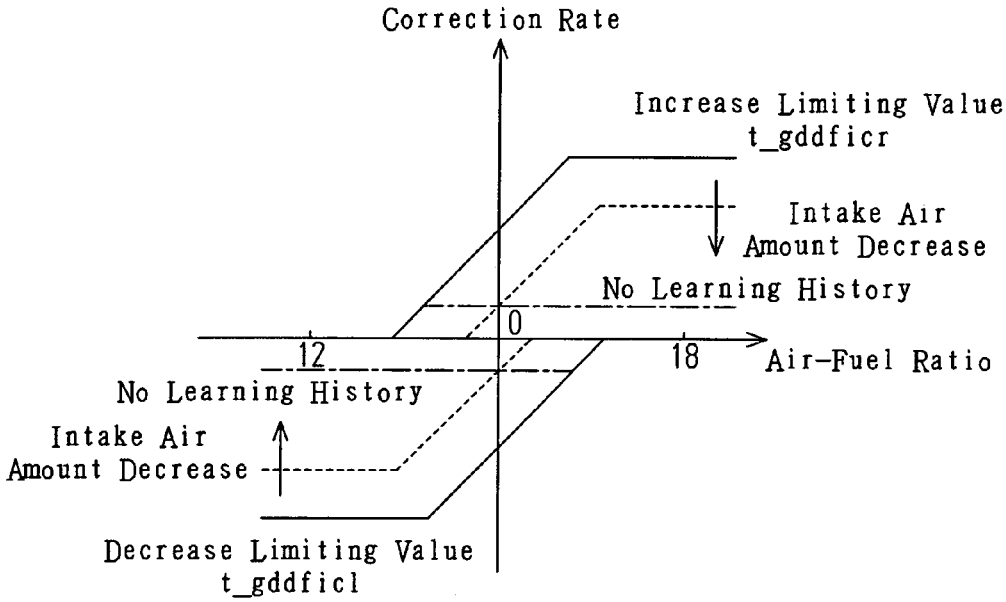
FIG. 7 is a correction rate limiting map according to the same embodiment.

In Step 148, the ECU 30 calculates a decrease limiting value t_gddficl and an increase limiting value t_gddficr in accordance with the magnitudes of the actual air-fuel ratio eabyf and intake air amount ega by referring to the map given in FIG. 7. As illustrated in FIG. 7, both a decrease in the limiting value t_gddficl and an increase in the limiting value t_gddficr are set in such a way as to converge to 0 as the intake air amount decreases.

In Step 150, the ECU 30 determines whether or not there is an air-fuel ratio learning history in an actual load region. When determining that there is no air-fuel ratio learning history (NO), the ECU 30 implements Step 152 and then Step 154. Otherwise (YES), the ECU 30 directly implements S154 bypassing Step 152.

In Step 152, the ECU 30 changes the decrease limiting value t_gddficl or the increase limiting value t_gddficr to a level close to 0, irrespective of the intake air amount or the air-fuel ratio (as indicated by the broken line shown in FIG. 7).

In Step 154, the ECU 30 sets upper and lower limits (upper and lower correction rates, respectively) for a reduced correction rate for the integral term edfii, the former being the basic correction rate efafki added with the increase limiting value t_gddficr, and the latter being the basic correction rate efafki subtracted by the decrease limiting value t_gddficl. The reduced correction rate for the integral term edfii means the integral term efafki divided by the basic injection amount efcb. Then, the ECU 30 temporarily stops the processing routine.

The correction amount limiting control described above sets upper and lower limits for the integral term edfii (more strictly, a reduced correction rate for the integral term edfii) based on the basic correction rate efafki and the increase limiting value t_gddficr or the decrease limiting value t_gddficl. The increase limiting value t_gddficr and decrease limiting value t_gddficl are set by the actual intake air amount ega and the actual air-fuel ratio eabyf, respectively. In this embodiment, therefore, the integral term edfii is limited within the upper and lower limits determined in accordance with the actual intake air amount ega and the actual air-fuel ratio eabyf. This limitation prevents an integral term from being set at an excessively high or low level which may lead to erroneous air-fuel ratio correction removed from the realities of the intake air amount ega and the actual air-fuel ratio eabyf.

More specifically, the increase limiting value t_gddficr and the decrease limiting value t_gddficl are set in such a way as to reduce the interval between the upper and lower limits of the integral term edfii, or reduce the absolute value of each limit, as the actual intake air amount ega decreases. This prevents excessive correction at a low intake air amount while adequately maintaining convergence for the air-fuel ratio feedback control at a high intake air amount, which tends to increase deviation of the air-fuel ratio from its target.

Moreover, the increase limiting value t_gddficr and the decrease limiting value t_gddficl are set in such a way as to limit the actual air-fuel ratio eabyf when it is lean, i.e., in such a way as to limit the air-fuel ratio correction by the integral term edfii to the lean side. This prevents the air-fuel ratio from becoming excessively lean as a result of correction by the integral term edfii.

Figure 8:
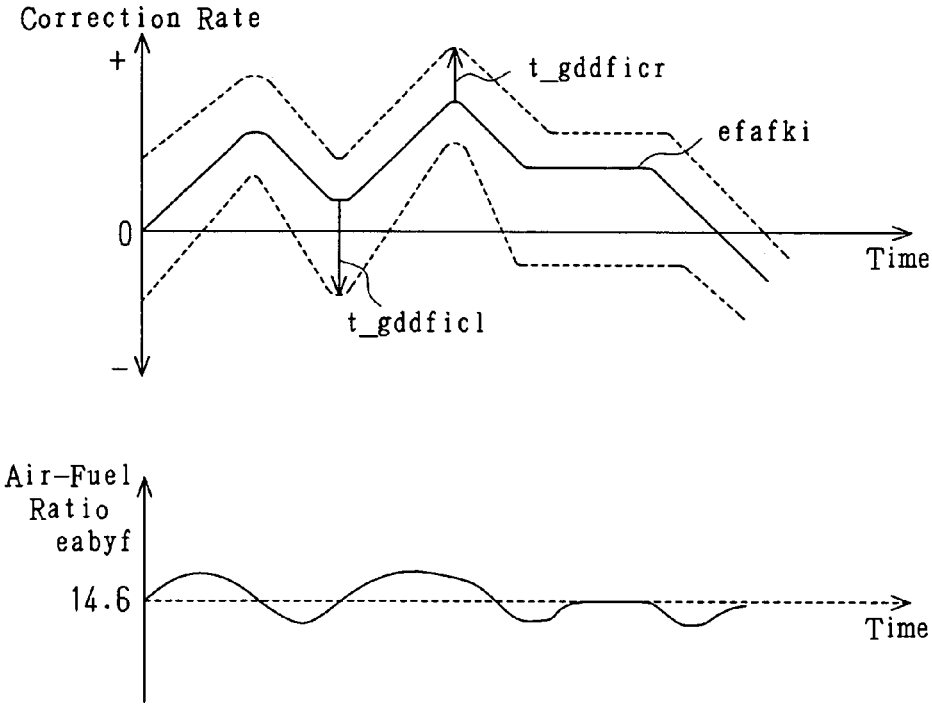
FIG. 8 is a time chart illustrating the air-fuel ratio feedback control according to the same embodiment.

It should be noted that simply limiting the range for the integral term edfii by setting the upper and lower limits may deteriorate convergence of the air-fuel ratio eabyf to a target ratio when there is a significant difference between them, because of insufficient air-fuel ratio correction. In this regard, this embodiment varies the basic correction rate efafki in accordance with the actual air-fuel ratio eabyf, as illustrated in FIG. 8. More specifically, it sets the upper and lower limits of the integral term edfii in such a way as to allow larger correction of the air-fuel ratio to the lean side as the actual air-fuel ratio eabyf is continuously leaner than the target ratio, or to allow larger correction of the air-fuel ratio by the integral term to the rich side as the actual air-fuel ratio is continuously richer than the target ratio. This secures convergence of the air-fuel ratio feedback control to the target ratio.

On the other hand, this embodiment implements the air-fuel ratio learning control with a stored air-fuel ratio learning value kg, which is a steady state deviation between the actual air-fuel ratio eabyf and the stoichiometric air-fuel ratio, obtained from the history of the differences in the air-fuel ratio feedback control. The air-fuel ratio may not be simply converged to the target air-fuel ratio depending on the transition of the actual air-fuel ratio eabyf to that point. This possibly leads to retarded learning or deteriorated learning accuracy.

In this regard, this embodiment sets the increase limiting value t_gddficr and the decrease limiting value t_gddficl in such a way as to reduce the interval between the upper and lower limits of the integral term edfii, or reduce the absolute value of each limit, until completion of a steady state deviation calculation, i.e., the air-fuel ratio learning value kg calculation, in the air-fuel ratio learning control. This controls integral correction of the air-fuel ratio to a relatively limited extent before completion of learning with the air-fuel ratio learning value kg to suitably maintain learning speed and accuracy.

Figure 9:
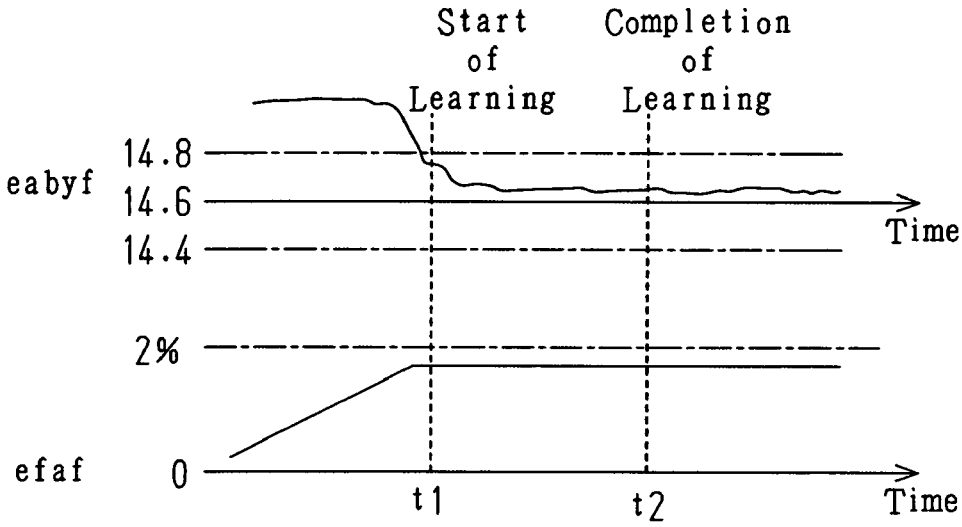
FIG. 9 is a time chart illustrating the air-fuel ratio feedback control according to the same embodiment.

FIG. 9 shows the actual air-fuel ratio eabyf and the feedback correction ratio efaf (i.e., the feedback correction amount edfi divided by the basic injection amount efcb) changing with time. As described above, this embodiment sets the upper and lower limits in such a way as to keep the integral term edfii at a value close to 0 until completion of the air-fuel ratio learning value kg calculation, as a result of which the air-fuel ratio feedback control is mainly implemented by the proportional correction, with essentially no integral correction. Therefore, the actual air-fuel ratio eabyf promptly converges to a value close to the stoichiometric air-fuel ratio, as illustrated in FIG. 9, to also promptly complete the air-fuel ratio learning control.

Figure 10:
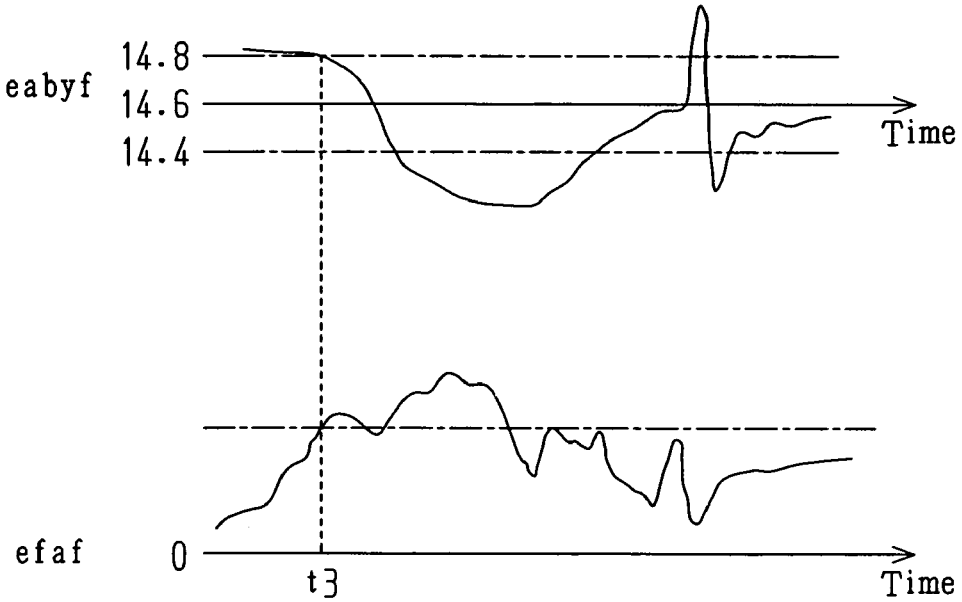
FIG. 10 is a time chart illustrating the air-fuel ratio feedback control without correction rate limiting.

On the other hand, FIG. 10 shows the actual air-fuel ratio eabyf and the feedback correction ratio efaf changing with time similar to the learning control as with the air-fuel ratio learning value kg but without limiting the range of the integral term edfii by the upper and lower limits. Integral correction of the air-fuel ratio without limiting range of the integral term causes retarded learning and deteriorated learning accuracy, resulting from deteriorated convergence and instability of the actual air-fuel ratio eabyf, as illustrated in FIG. 10.

The following modifications of the above embodiment are also within the scope of the present invention.

Step 152 described above sets the increase limiting value t_gddficr and the decrease limiting value t_gddficl in the case of no history for air-fuel ratio learning. In one modification, these values may be set at 0 (cleared). This fixes the integral term edfii at the basic correction rate efafki to further limit integral correction of the air-fuel ratio, thereby further reducing retarded learning or deteriorated learning accuracy with the air-fuel ratio learning value kg, which may result from integral correction.

Steps 150 and 152 in the above embodiment, which implement correction amount limiting control, may be skipped, when an adverse effect of integral correction of air-fuel ratio on learning time or accuracy is negligible, e.g., when no air-fuel ratio learning control is implemented.

The above embodiment varies the basic correction rate efafki in accordance with the history of the actual air-fuel ratios eabyf. However, the basic correction rate efafki may be set at a fixed value, e.g., 0. The range of the integral term edfii is limited also in this case in accordance with the actual intake air amount ega and the actual air-fuel ratio eabyf. Therefore, this modification prevents erroneous air-fuel correction, removed from the realities of actual intake air amount ega and the actual air-fuel ratio eabyf.

Step 112 for finding the feedback correction amount edfi, illustrated in FIG. 4, may be modified to add a derivative action, i.e., to implement proportional plus integral plus derivative (PID) action, where a derivative term, which is a product of a derivative of fuel difference and a derivative gain, is additionally included in the feedback correction amount edfi.

The present invention is applicable to various internal combustion engines, not limited to the port injection type illustrated in FIG. 1, with fuel injected into an air intake port. For example, it is applicable to a cylinder injection type with fuel directly injected into a cylinder.

The invention claimed is:

1. An air-fuel ratio control apparatus for an internal combustion engine, the apparatus comprising a control unit that includes control logic implementing integral correction of the air-fuel ratio with an integral term, the integral term being obtained by multiplying an integrated difference between a target air-fuel ratio and the actual air-fuel ratio by an integral gain, wherein an upper limit value and a lower limit value of the integral term are set based on an actual intake air amount and an actual air-fuel ratio, and the upper and lower limit values are set in such a way to reduce the interval between the limit values as the actual intake air amount decreases.

2. The air-fuel ratio control apparatus for an internal combustion engine according to claim 1, wherein the upper and lower limit values are set in such a way to allow larger correction of the air-fuel ratio with the integral term for a lean air-fuel ratio as the actual air-fuel ratio remains leaner than the target ratio for a longer period.

3. The air-fuel ratio control apparatus for an internal combustion engine according to claim 1, wherein the upper and lower limit values are set in such a way to allow larger correction of air-fuel ratio with the integral term for a rich air-fuel ratio as the actual air-fuel ratio remains richer than the target ratio for a longer period.

4. An air-fuel ratio control apparatus for an internal combustion engine, the apparatus comprising a control unit that includes control logic implementing integral correction of the air-fuel ratio with an integral term, the integral term being obtained by multiplying an integrated difference between a target air-fuel ratio and the actual air-fuel ratio by an integral gain, wherein an upper limit value and a lower limit value of the integral term are set based on an actual intake air amount and an actual air-fuel ratio, and the upper and lower limit values are set in such a way to reduce the absolute value of each limit value as the actual intake air amount decreases.

5. The air-fuel ratio control apparatus for an internal combustion engine according to claim 4, wherein the upper and lower limit values are set in such a way to allow larger correction of the air-fuel ratio with the integral term for a lean air-fuel ratio as the actual air-fuel ratio remains leaner than the target ratio for a longer period.

6. The air-fuel ratio control apparatus for an internal combustion engine according to claim 4, wherein the upper and lower limit values are set in such a way to allow larger correction of air-fuel ratio with the integral term for a rich air-fuel ratio as the actual air-fuel ratio remains richer than the target ratio for a longer period.

7. An air-fuel ratio control apparatus for an internal combustion engine, the apparatus comprising a control unit that includes control logic implementing integral correction of the air-fuel ratio with an integral term, the integral term being obtained by multiplying an integrated difference between a target air-fuel ratio and the actual air-fuel ratio by an integral gain, wherein an upper limit value and a lower limit value of the integral term are set based on an actual intake air amount and an actual air-fuel ratio, and the upper and lower limit values are set in such a way that air-fuel ratio correction with the integral term for a lean air-fuel ratio is limited as the actual air-fuel ratio becomes leaner.

8. The air-fuel ratio control apparatus for an internal combustion engine according to claim 7, wherein the upper and lower limit values are set in such a way to allow larger correction of the air-fuel ratio with the integral term for a lean air-fuel ratio as the actual air-fuel ratio remains leaner than the target ratio for a longer period.

9. The air-fuel ratio control apparatus for an internal combustion engine according to claim 7, wherein the upper and lower limit values are set in such a way to allow larger correction of air-fuel ratio with the integral term for a rich air-fuel ratio as the actual air-fuel ratio remains richer than the target ratio for a longer period.

10. An air-fuel ratio control apparatus for an internal combustion engine, the apparatus comprising a control unit that includes control logic implementing integral correction of the air-fuel ratio with an integral term, the integral term being obtained by multiplying an integrated difference between a target air-fuel ratio and the actual air-fuel ratio by an integral gain, wherein an upper limit value and a lower limit value of the integral term are set based on an actual intake air amount and an actual air-fuel ratio, and air-fuel ratio learning control is implemented, in which a steady state deviation between the actual air-fuel ratio and the target air-fuel ratio is computed based on the history of difference between the air-fuel ratios, and the computed steady state deviation is stored as a learning value, and wherein, until the computation of the steady state deviation is completed, the upper and lower limit values are set in such a way to have a smaller interval between the limit values than that after the computation of the steady state deviation is completed.

11. An air-fuel ratio control apparatus for an internal combustion engine, the apparatus comprising a control unit that includes control logic implementing integral correction of the air-fuel ratio with an integral term, the integral term being obtained by multiplying an integrated difference between a target air-fuel ratio and the actual air-fuel ratio by an integral gain, wherein an upper limit value and a lower limit value of the integral term are set based on an actual intake air amount and an actual air-fuel ratio, and air-fuel ratio learning control is implemented, in which a steady state deviation between the actual air-fuel ratio and the target air-fuel ratio is computed based on a history of difference between the air-fuel ratios, and the computed steady state deviation is stored as a learning value, and wherein, until the computation of the steady state deviation is completed, the upper and lower limits are set in such a way to each have a smaller absolute value than that after the computation of the steady state deviation is completed.

* * * * *